US007434793B2

(12) United States Patent
Kunath et al.

(10) Patent No.: US 7,434,793 B2
(45) Date of Patent: Oct. 14, 2008

(54) COATING FOR A THROTTLE BODY

(75) Inventors: Edward Carlton Kunath, Detroit, MI (US); Dennis Lanni, Shelly, MI (US); Mathias Warmbrunn, Troy, MI (US)

(73) Assignee: Continental Automotive Systems US, Inc., Auburn Hills ( * ) Notice: Subject to any disclaimer, the term of this patent is extended or adjusted under 35 U.S.C. 154(b) by 299 days.

(21) Appl. No.: 11/205,163

(22) Filed: Aug. 17, 2005

(65) Prior Publication Data

US 2006/0037473 A1 Feb. 23, 2006

Related U.S. Application Data

(60) Provisional application No. 60/602,288, filed on Aug. 17, 2004.

(51) Int. Cl.
*F02M 17/50* (2006.01)

(52) U.S. Cl. ..... 261/38; 123/337; 251/305; 261/65; 261/DIG. 20; 427/490

(58) Field of Classification Search ..... 261/38, 261/62, 64.1, 65, DIG. 20, DIG. 12, DIG. 56; 123/337; 251/306, 305; 427/490
See application file for complete search history.

(56) References Cited

U.S. PATENT DOCUMENTS 2,059,687 A * 11/1936 Gagg ..... 251/286
2,402,208 A * 6/1946 Read ..... 261/41.5
2,457,085 A * 12/1948 Kliever ..... 261/135
2,658,734 A * 11/1953 Henning ..... 261/41.5
2,890,871 A * 6/1959 Lunn ..... 261/41.2
2,899,943 A * 8/1959 Haensel et al. ..... 123/1 A
3,057,606 A * 10/1962 Hegna ..... 261/65
4,798,191 A * 1/1989 King ..... 123/557
5,640,942 A 6/1997 Hollister
6,046,300 A * 4/2000 Umetsu et al. ..... 528/176
2006/0237862 A1 * 10/2006 Bollons ..... 261/130

FOREIGN PATENT DOCUMENTS

DE 19508355 6/1996
DE 19604009 8/1996
GB 2131918 A * 6/1984 ..... 251/306
JP 08-014069 1/1996

* cited by examiner

*Primary Examiner*—Richard L Chiesa

(57) ABSTRACT

A throttle body for an air intake system of an internal combustion engine, which includes a combustion chamber. The throttle body includes a body, a throttle plate and a coating. The body defines a throat through which air flows to the combustion chamber. The throttle plate, which is pivotally mounted with respect to the body, moves between first and second configurations with respect to the throat. The first configuration of the throttle plate substantially prohibits the air flow through the throat, and the second configuration of the throttle plate permits air flow through the throat. The coating, which is on at least one of the throat and the throttle plate, sheds contaminants that extend between the body and the throttle plate in the first configuration of the throttle plate.

15 Claims, 2 Drawing Sheets

COATING FOR A THROTTLE BODY

CROSS REFERENCE TO RELATED APPLICATIONS

This application claims the benefit of the earlier filing date of U.S. Provisional Application No. 60/602,288, filed 17, Aug. 2004, which is incorporated by reference herein in its entirety.

FIELD OF THE INVENTION

A throttle body controls air intake through an intake manifold to an internal combustion engine. Typically, a throttle body includes a bore and a throttle plate. The bore defines a throat through which air flows to a combustion chamber of the internal combustion engine, and the throttle plate is a pivotal valve member that controls the air flow volume.

BACKGROUND OF THE INVENTION

The intake manifold may create a condition where vapors of the combustion process are not vented while the internal combustion engine is shut down. The resulting condensation may collect at the base of the bore that defines the throat of the throttle body. If the ambient temperature is below freezing, the condensation may freeze so as to form an ice "bridge" at a gap between a throttle plate and the bore. The throttle body may not have enough force to remove the ice bridge when the internal combustion engine is started up.

It is known that the ice may be removed by implementing with software a particular motion of the throttle plate with respect to the bore. This method of removing ice suffers from a number of disadvantages that include modifying the operation of the throttle body. Moreover, this method constitutes a cure rather than preventing formation of the ice bridge.

Thus, it would be advantageous to mitigate, and preferably eliminate, the formation of ice extending between the throttle plate and the bore.

SUMMARY OF THE INVENTION

The present invention provides a throttle body for an air intake system of an internal combustion engine, which includes a combustion chamber. The throttle body includes a body, a throttle plate and a coating. The body defines a throat through which air flows to the combustion chamber. The throttle plate, which is pivotally mounted with respect to the body, moves between first and second configurations with respect to the throat. The first configuration of the throttle plate substantially prohibits the air flow through the throat, and the second configuration of the throttle plate permits air flow through the throat. The coating, which is on at least one of the throat and the throttle plate, sheds contaminants that extend between the body and the throttle plate in the first configuration of the throttle plate.

The present invention also provides an improved throttle body for an air intake system of an internal combustion engine, which includes a combustion chamber. The throttle body includes a body, which defines a throat through which air flows to the combustion chamber, and a throttle plate that is pivotally mounted with respect to the body. The improvement includes a coating on at least one of the throat and the throttle plate. The coating sheds contaminants extending between the body and the throttle plate.

The present invention also provides a fluid flow controller including a seat that defines a throat through which fluid flows, a valve mounted movably with respect to the seat, and a coating on at least one of the seat and the valve. The valve moves between first and second configurations with respect to the throat. The first configuration of the valve substantially occludes the throat, and the second configuration of the valve permits fluid flow through the throat. The coating sheds contaminants extending between the seat and the valve in the first configuration of the valve.

The present invention also provides a method of mitigating ice formation in a throttle body for an air intake system of an internal combustion engine, which includes a combustion chamber. The method includes providing a body, which defines a throat through which air flows to the combustion chamber, and providing a throttle plate that is pivotally mounted with respect to the body to control air flow through the throat, and applying to at least one of the throat and the throttle plate a coating to shed water that extends between the throat and the throttle plate.

The present invention also provides an internal combustion engine throttle valve that is coated/plated on the throat and/or valve plate with a thin, low friction coating/plating. The coating prevents the formation of ice and, should it form, allows the ice to be easily removed by the force of the plate movement.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
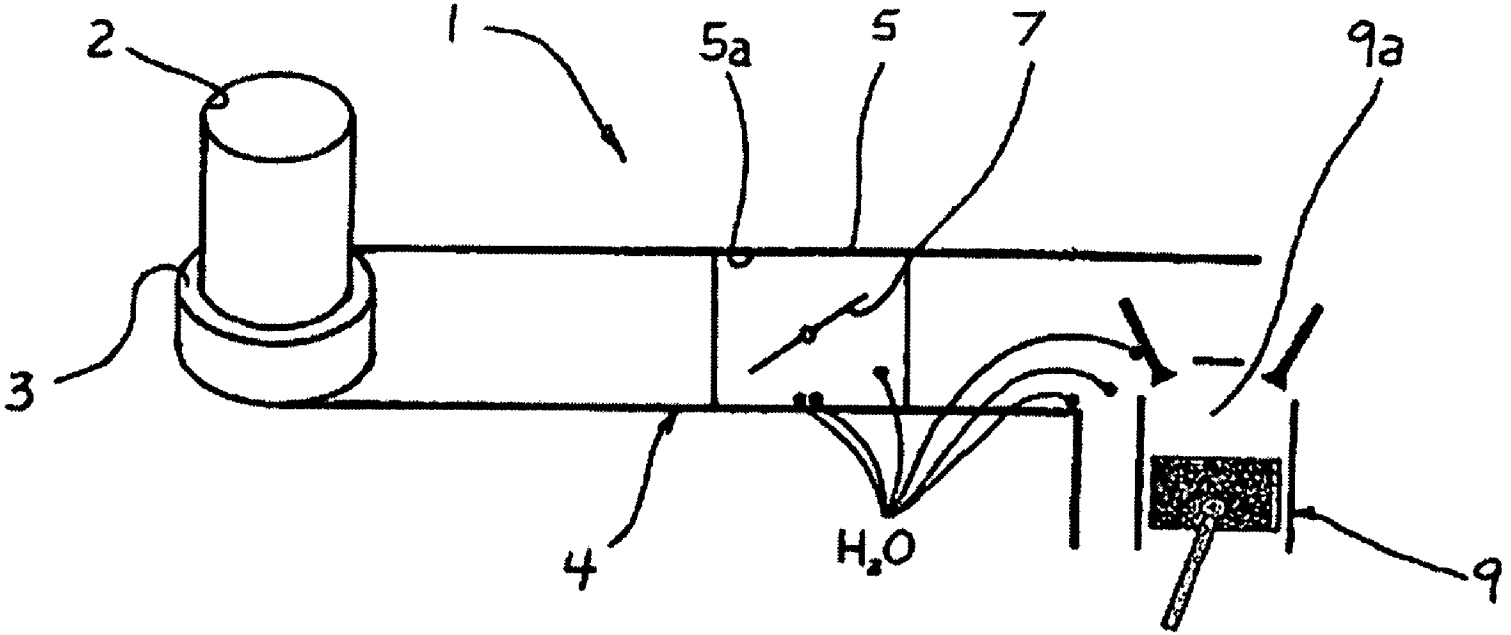
Figure 1 Prior Art
FIG. 1 is a schematic illustration of an air intake system on an internal combustion engine.

FIG. 1 shows an air intake system 1 for an internal combustion engine 9. The air induction system 1 includes an air intake 2, an air cleaner 3, e.g., an air filter, and an intake manifold 4. The intake manifold 4 may include, integrally or separately, a throttle body 5 defining a throat 5*a*, and a throttle plate 7. It is believed that condensate H.sub. of the vapors of the combustion process in a combustion chamber 9*a* that are not vented while the internal combustion engine 9 is shut down may collect at a base of the throat 5*a* of the throttle body 5.

Figure 2:
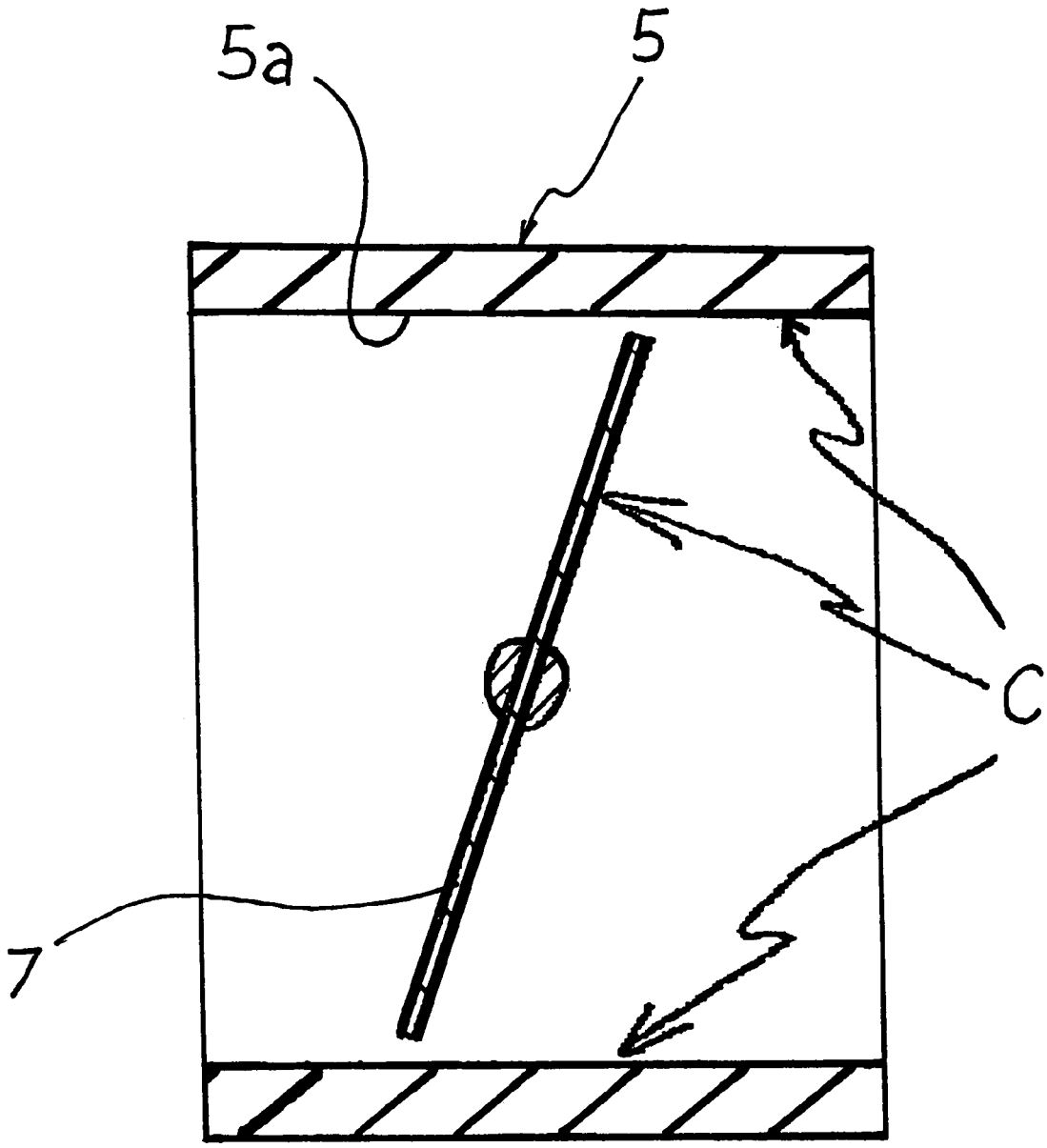
FIG. 2 is a schematic illustration of a throttle body according to a preferred embodiment.

Referring additionally to FIG. 2, the throttle body 5, which is preferably metallic, includes a coating C is applied to the throat 5*a*, the throttle plate 7, or both. The coating C provides surface(s) on which contaminants, e.g., water, are more likely to shed as compared to the bare metal surface(s) of the throat 5*a* or the throttle plate 7. By allowing water to shed, the incidence of ice is reduced, and preferably eliminated. Should ice form between the throttle plate 7 and the throat 5*a*, the non-stick nature of the coating C will enhance ice removal upon motion of the throttle plate 7. Thus, the formation of ice that extends between the throat 5*a* and the throttle plate 7, which could impede the normal pivoting motion of the throttle plate 7 with respect to the throttle body 5, is at least mitigated and preferably prevented. It will be appreciated that the present invention is highly cost effective and efficient to implement as compared to, for example, reprogramming the software driving the actuator (not shown) for the throttle plate 7.

According to a preferred embodiment, the coating C is a composition of a metal and a low-friction substance that are simultaneously applied. The metal used for the basis of the coating is preferably nickel and the low-friction substance is preferably polytetrafluoroethylene (Teflon®).

The coating C may be applied by an electro-less technique, by electroplating and/or by vapor deposition process so as to achieve a thin (preferably no greater than five microns) and uniform thickness of the coating C. Preferably, an electro-less technique is used.

Alternatively, the coating C may be applied by spraying. However, due to the inherent nature of an operator applied process, variations in thickness may be possible and therefore it would be desirable to incorporate a control on the thickness of the coating so as to maintain the needed tolerances. Coating with large tolerances may increase the gap between the edge of the throttle plate 7 and the throat 5*a*, thereby increasing the "closed plate" or leakage airflow. Pure Teflon® or fluorinated ethylene propylene (FEP) or other similar non-stick coatings may be applied by a spraying technique.

Of course, the present invention is also applicable to valves other than throttle bodies that are also made of metal and are exposed to moisture or other contaminants. In particular, the present invention is applicable to valves that are often held in a closed or mostly closed position.

There are a number of advantages according to the present invention. These include providing a coating of the purpose of prevention and removal of ice formation; providing a coating that is metal based for resistance to abrasion and adhesion with a percentage of a non-stick material (preferably, a composition of nickel with 25% Teflon®); and providing a thin (preferably less than five microns) coating via electro-less deposition to achieve an even coating, regardless of shape or location, and thereby not interfere with manufacturing or design and have no affect on leakage airflow.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A throttle body for an air intake system of an internal combustion engine including a combustion chamber, the throttle body comprising:

a body defining a throat through which air flows to the combustion chamber;

a throttle plate being pivotally mounted with respect to the body, the throttle plate moving between first and second configurations with respect to the throat, the first configuration of the throttle plate substantially prohibiting the air flow through the throat, and the second configuration of the throttle plate permitting air flow through the throat; and a coating on at least one of the throat and the throttle plate, the coating shedding ice bridges and contaminants extending between the body and the throttle plate in the first configuration of the throttle plate.

2. The throttle body according to claim 1, wherein the coating comprises a first coating on the throat and a second coating on the throttle plate.

3. The throttle body according to claim 2, wherein the first coating has a first thickness, the second coating has a second thickness, and the second thickness is substantially equal to the first thickness.

4. The throttle body according to claim 3, wherein the first and second thickness are in a range of one microns to five microns.

5. The throttle body according to claim 1, wherein the coating comprises a low-friction substance.

6. The throttle body according to claim 5, wherein the coating comprises a composition of metal and at least one of polytetrafluoroethylene and fluorinated ethylene propylene.

7. The throttle body according to claim 6, wherein the metal comprises nickel.

8. The throttle body according to claim 1, wherein the coating comprises a thickness in a range of one microns to five microns.

9. A fluid flow controller, comprising:

a seat defining a throat through which fluid flows;

a valve mounted movably with respect to the seat, the valve moving between first and second configurations with respect to the throat, the first configuration of the valve substantially occluding the throat, and the second configuration of the valve permitting fluid flow through the throat; and a coating on at least one of the seat and the valve, the coating shedding ice bridges and contaminants extending between the seat and the valve in the first configuration of the valve.

10. The fluid flow controller according to claim 9, wherein the coating comprises a composition of nickel and at least one of polytetrafluoroethylene and fluorinated ethylene propylene.

11. A method of mitigating ice formation extending from a throttle body to a throttle plate in an air intake system of an internal combustion engine including a combustion chamber, the method comprising:

providing a body and a throttle plate, the body defining a throat through which air flows to the combustion chamber, and the throttle plate being pivotally mounted with respect to the body to control air flow through the throat;

applying to at least one of the throat and the throttle plate a coating to shed water extending between the throat and the throttle plate; and removing ice bridges formed and extending between the throat and the throttle plate when the internal combustion engine is shut down by pivoting the throttle plate to remove the ice from the coating.

12. The method according to claim 11, wherein the applying comprises at least one of electrolysis, electroplating, vapor deposition, and spraying.

13. The method according to claim 12, wherein the applying provides a uniform coating having a thickness in a range of one microns to five microns.

14. The method according to claim 11, wherein the coating comprises a composition of metal and at least one of polytetrafluoroethylene and fluorinated ethylene propylene.

15. The method according to clam 14, wherein the metal comprises nickel.

* * * * *